US006133823A

United States Patent [19]

Brown et al.

[11] Patent Number: 6,133,823

[45] Date of Patent: Oct. 17, 2000

[54] ELECTRONIC NOVELTY DEVICE

[76] Inventors: Raymond R. Brown, 1272 Lenhill Ct., Bloomfield Hills, Mich. 48304; S. Miller Weisman, II, 24044 Bingham Pointe, Bingham Farms, Mich. 48025

[21] Appl. No.: 09/450,048

[22] Filed: Nov. 29, 1999

[51] Int. Cl.[7] ..... G08B 3/10

[52] U.S. Cl. ..... 340/384.7; 340/384.1; 369/135; 369/137

[58] Field of Search ..... 340/384.7, 384.1, 340/384.3, 384.6, 384.71, 384.72, 384.73; 369/135, 137

[56] References Cited

U.S. PATENT DOCUMENTS

| | | | |
|---|---|---|---|
| 4,810,997 | 3/1989 | Kudo et al. | 340/384.6 |
| 4,973,941 | 11/1990 | Davis et al. | 340/384.6 |
| 6,046,670 | 4/2000 | Martin | 340/384.3 |

*Primary Examiner*—Daryl Pope
*Attorney, Agent, or Firm*—Bill C. Panagos

[57] ABSTRACT

An electronic audible novelty device, comprising a body having a planar bottom surface, a top surface in spaced relation to said bottom surface having at least a portion thereof which is resiliently deformable, and a sidewall extending unbroken therebetween to define an interior and exterior, an electronic circuit assembly mounted on the interior surface of said planar surface in said body including an electronic circuit unit which is programmed with at least one sound sequence; said sound sequence programmed to be time delayed, a pressure sensitive adhesive layer deposited upon at least a portion of the exterior surface of said planar surface, sound producing means mounted on said interior surface for receiving said sound sequence from said electronic circuit unit and converting the same into audible sounds, a normally open switch carried within said body and connected to said electronic circuit unit for activating the same; said electronic circuit unit having a pair of conductive ends which are connectable to said switch, and an electric power source electrically connected to said electronic circuit unit and connectable to said switch whereby deforming the resilient portion of the top surface of the body closes the switch, thereby connecting the power source to the switch and the electronic circuit unit, thereby activating the circuit assembly to produce audible sounds.

12 Claims, 2 Drawing Sheets

ELECTRONIC NOVELTY DEVICE

BACKGROUND OF THE INVENTION

1. Field of the Invention

The present invention relates to an electronic novelty device to produce audible sounds in a variety of modes, from momentary production of sound to set switch delayed sound production.

The present invention relates to an electronic novelty device to produce audible sounds in a time delayed manner.

The present invention further relates to an electronic novelty device which is programmable to produce sounds in a time delayed manner.

The present invention further relates to and electronic novelty device which may be mounted on any planar surface such that it is easily concealable.

The present invention further relates to an electronic audible novelty device having a body constructed of a top surface, a portion of which is resiliently deformable, in spaced apart relation to a planar bottom surface with a sidewall extending unbroken therebetween, an electronic circuit assembly mounted on the planar surface in the body including an electronic circuit programmed with at least one sound sequence, a speaker or transducer to convert the sound sequence to audible form, a normally open switch, and an electric power source, a pressure sensitive adhesive layer on the exterior of the planar surface such that the body is attachable to any surface by means of the adhesive layer. By deforming the top surface of the body proximal to the switch, the switch is closed, thereby connecting the power source to the electronic circuit unit and activating the circuit assemble to produce time delayed audible sounds.

2. Description of the Related Art

Lee et al. U.S. Pat. No. 5,648,129 relates to a melodic party favor which is comprised of an electronic circuit within a body. The body is comprised of a gripping portion providing for a handgrip. The unit has a power source, and electronic circuit unit, a sound production means and a normally open switch mechanism. The switch mechanism is comprised of two electrically conductive ends and a resistor. The conductive ends are not in contact with each other and are disposed within the gripping portion of the body. The circuit is activated by simultaneously contacting the conductive ends in the gripping portion with an electrically conductive article, such a person's hands.

The present invention does not include gripping portions, and does not complete a circuit when the conductive ends are gripped by a person. Rather, a circuit is completed when a normally open switch is closed. Further, there is no resistor in the switch mechanism of the present invention. There is no showing in Lee et al of a resiliently deformable body having a planar surface coated with an adhesive to mount the unit to any surface. There is no showing of a normally open switch which is closed by deforming a resiliently deformable body. There is no showing of providing for time delayed sound sequence. For these and many other reasons which are apparent, the present invention differs from Lee et al.

SUMMARY OF THE INVENTION

The present invention is an electronic audible device comprising a body having at least one planar surface, and adhesive coating deposited upon said planar surface, an electronic circuit assembly mounted in said body and including an electronic circuit unit programmed with at least one sound sequence which is transmitted in a time delayed manner, sound producing means for receiving the sound sequence for the electronic circuit and converting it into audible sounds, a normally open switch carried with in the body and connectable to the electronic circuit unit for activating the same, and an electric power source electrically connected to the electronic circuit and connectable to the switch. The body includes a top surface which is resiliently deformable, and when deformed, the switch is at least momentarily closed thereby activating the circuit assembly to produce time delayed audible sounds.

It is contemplated that the adhesive layer has a removable protective membrane over the adhesive layer and that the electronic circuit unit is programmed with at a plurality of different sound sequences. The time delay period for transmittal of the sound sequence may be programmed for two or more different time periods of the same or different duration, and the switch may be reopened after it is closed by resiliently deforming the body. In the preferred embodiment, the switch is designed to be activated by momentary contact of the switch.

DETAILED DESCRIPTION OF A PREFERRED EMBODIMENT

Figure 1:
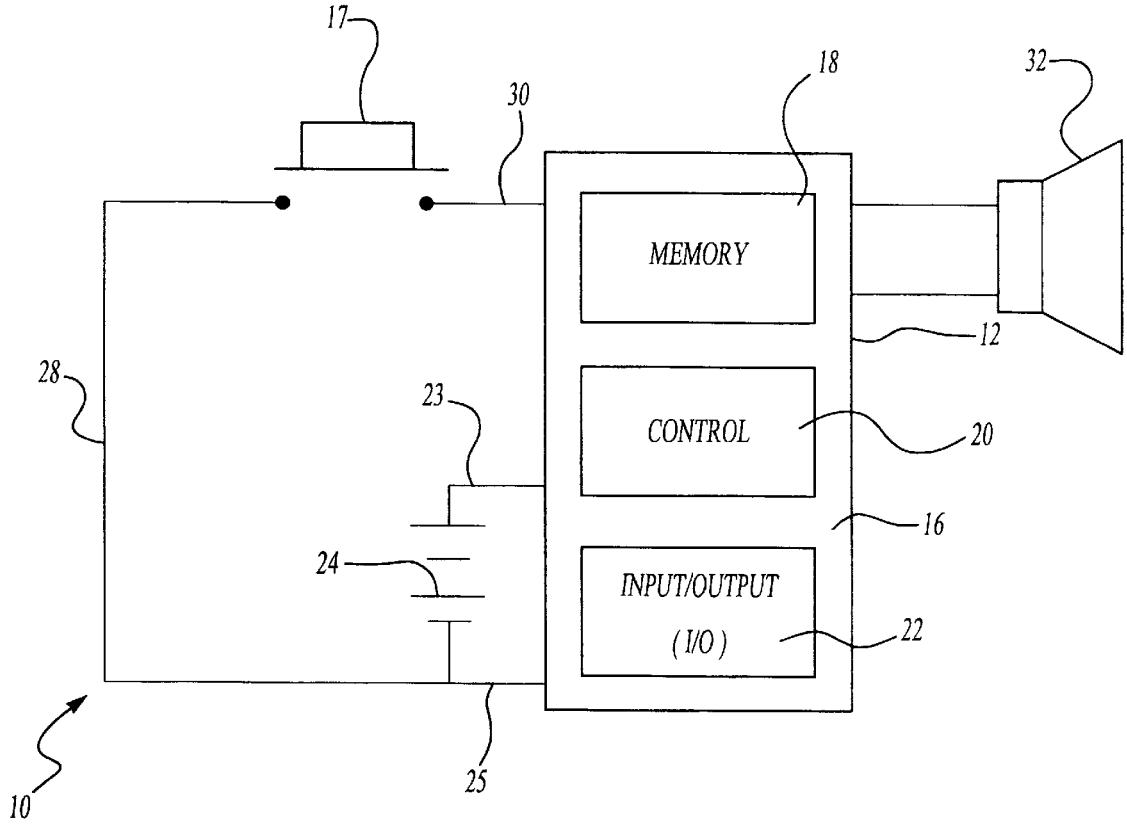
FIG. 1 is a schematic view of the electronic novelty unit of the present invention showing the componentry of one contemplated configuration.

Turning now to the Figures, wherein like numerals depict like structures, and particularly to FIG. 1, there is illustrated therein a schematic view of one preferred embodiment of the present invention. Electronic audible novelty device 10 includes an electronic circuit assembly 12. The electronic circuit assembly is comprised of an electronic circuit unit 16 having a memory 18, a control 20, and an input output (I/O) 22, as is conventional with electronic circuits. A power source 24, depicted as a battery, is electrically connected to the electronic circuit by an input pin 23 and ground pin 25 as is conventional in the art. A lead 26 leads from the battery to an open switch 28. The electronic circuit includes a lead 30 from the electronic circuit and proximal to a normally open switch 17. A sound receiving means 32, which may be a piezo electric transducer, a micro-speaker, or any other sound receiving component, is electrically connected to the electronic circuit unit to receive the sound sequences and convert them into audible sounds.

The electronic circuit is programmed with at least one, and preferably a plurality of different sound sequences. The electronic circuit may be programmed such that the sound sequences are played in sequential or random order. Further, it is preferred that the electronic circuit may be programmed such that the sound sequences are played in a delayed sequence and at random times after the closing of the switch.

The switch may assume a number of configurations. It is contemplated that once the switch is closed, it cannot be reopened. It is further contemplated to be a simple two way switch or it may be a time delayed switch. In the case that a time delayed switch is used, there would be no need to program the electronic circuit unit to play the sound sequences in a time delayed manner as the time delay in the switch would accomplish that purpose.

Figure 2:
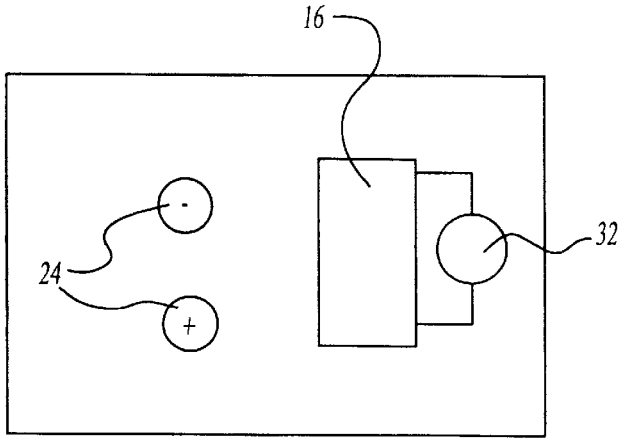
FIG. 2 is a cut away top view of the electronic novelty unit.

Turning again to FIG. 2, there is shown therein a cut away overview of the electronic novelty device of the present invention. Two individual power sources are disclosed, however, it is contemplated that one or more power sources could be used, depending upon the power demands of the electronic circuit and sound receiving means.

Figure 3:
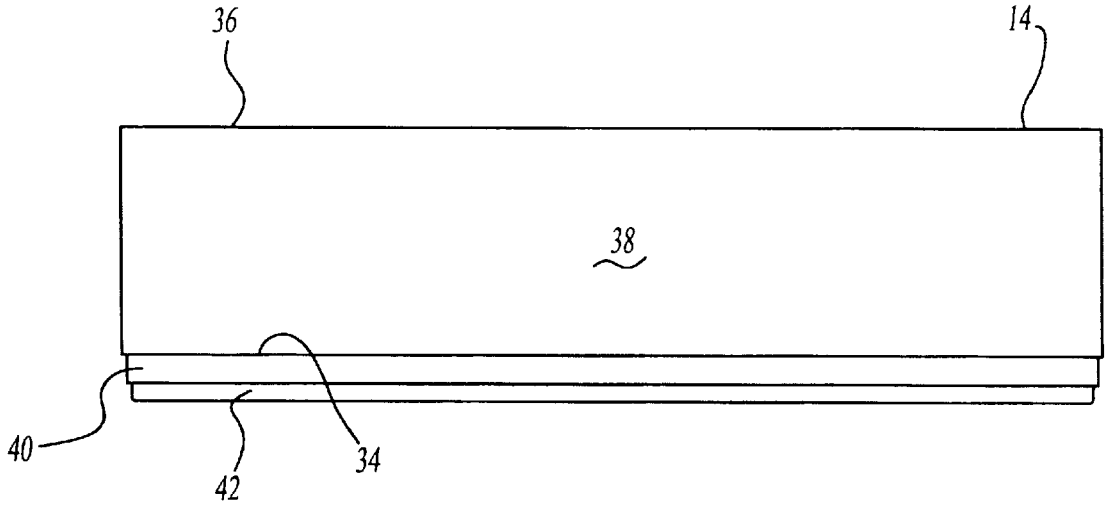
FIG. 3 is a side view of the electronic novelty unit

Turning to FIG. 3, body 14 is comprised of a rigid planar bottom surface 34. The electronic circuitry is mounted on the interior surface of the planar bottom. Top surface 36 is in spaced apart proximity to the bottom surface and at least partially made of a resiliently deformable material, preferably a plastic or rubber material, along the portion thereof which overlays the switch. Sidewalls 38 extend unbroken between the top and bottom surfaces to define the body. Thus it can be seen that there is an interior portion and an exterior portion to the body and its constituent parts.

A pressure sensitive adhesive layer 40 is deposited upon the planar bottom surface opposite to the side upon which the electronic circuitry is mounted. The adhesive is selected from any one of a large number of such adhesives as is known in the art. It is further contemplated that a protective membrane 42 may be removably adhered to the adhesive layer to protect it against dirt or inadvertent adherence to a surface such that when it is desired to adhere the electronic novelty device, the protective membrane is removed and the adhesive layer is exposed. The unit is then attached to any surface by contacting the adhesive layer to the surface upon which the unit is to be mounted and applying some amount of pressure to secure the unit to the surface by the adhesive.

As can be seen by reference to FIG. 3, the electronic novelty unit body 14 has a low profile and can be easily concealable. Moreover, the top surface is resiliently deformable over at least the portion thereof which overlays the switch. Thus, by deforming the top surface adjacent to the switch, the switch is closed thereby completing the circuit and activating the unit.

While one preferred embodiment has been described, it will be apparent to those skilled in the art that many variations and modifications are possible without departing from the scope and spirit of the invention as set forth in the appended claims.

We claim:

1. An electronic audible novelty device, comprising:

(a) a body having a planar bottom surface, a top surface in spaced relation to said bottom surface having at least a portion thereof which is resiliently deformable, and a sidewall extending unbroken therebetween to define an interior and exterior;

(b) an electronic circuit assembly mounted on the interior surface of said planar surface in said body including an electronic circuit unit which is programmed with at least one sound sequence;

(c) a pressure sensitive adhesive layer deposited upon at least a portion of the exterior surface of said planar surface;

(d) sound producing means mounted on said interior surface for receiving said sound sequence from said electronic circuit unit and converting the same into audible sounds;

(e) a normally open switch carried within said body and connected to said electronic circuit unit for activating the same; said electronic circuit unit having a pair of conductive ends which are connectable to said switch; and (f) an electric power source electrically connected to said electronic circuit unit and connectable to said switch;

whereby deforming the resilient portion of the top surface of the body closes the switch, thereby connecting the power source to the switch and the electronic circuit unit, thereby activating the circuit assembly to produce audible sounds.

2. The electronic device of claim 1, further including a removable protective membrane over said adhesive surface.

3. The electronic device of claim 1, further including a plurality of programmed sounds in said electronic circuit unit.

4. The electronic unit of claim 1, wherein said switch is a time delayed switch programmable for at least two different time periods.

5. The electronic unit of claim 4, wherein said time periods are irregular in duration.

6. The electronic unit of claim 1, wherein said switch may be reopened after closing by depressing the body.

7. The electronic unit of claim 1, wherein said sound sequence is programmed to be time delayed, whereby closing the switch causes the sounds to be produced in a time delayed manner.

8. The electronic unit of claim 1, wherein said sound producing means is a micro-speaker.

9. The electronic unit of claim 1, wherein said sound producing means is a piezo electric transducer.

10. An electronic audible novelty device, comprising:

(a) a body having a planar bottom surface, a top surface in spaced relation to said bottom surface having at least a portion thereof which is resiliently deformable, and a sidewall extending at least partially therebetween to define an interior and exterior;

(b) an electronic circuit assembly mounted on the interior surface of said planar surface in said body including an electronic circuit unit which is programmed with at least one sound sequence; said sound sequence programmed to be time delayed;

(c) a pressure sensitive adhesive layer deposited upon at least a portion of the exterior surface of said planar surface;

(d) sound producing means mounted on said interior surface for receiving said sound sequence from said electronic circuit unit and converting the same into audible sounds;

(e) a normally open switch carried within said body and connected to said electronic circuit unit for activating the same; said electronic circuit unit having a pair of conductive ends which are connectable to said switch; and (f) an electric power source electrically connected to said electronic circuit unit and connectable to said switch;

whereby deforming the resilient portion of the top surface of the body closes the switch, thereby connecting the power source to the switch and the electronic circuit unit, thereby activating the circuit assembly to produce time delayed audible sounds.

11. The electronic unit of claim 10, wherein said sound producing means is a micro-speaker.

12. The electronic unit of claim 10, wherein said sound producing means is a piezo electric transducer.

* * * * *